US010163385B2

(12) United States Patent
Zheng et al.

(10) Patent No.: US 10,163,385 B2
(45) Date of Patent: Dec. 25, 2018

(54) DISPLAY DRIVER CIRCUITRY WITH SELECTIVELY ENABLED CLOCK DISTRIBUTION

(71) Applicant: Apple Inc., Cupertino, CA (US)

(72) Inventors: Fenghua Zheng, San Jose, CA (US); Christopher P. Tann, San Jose, CA (US); David S. Zalatimo, San Jose, CA (US); James E. C. Brown, San Jose, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 123 days.

(21) Appl. No.: 14/855,733

(22) Filed: Sep. 16, 2015

(65) Prior Publication Data

US 2016/0300546 A1 Oct. 13, 2016

Related U.S. Application Data

(60) Provisional application No. 62/146,127, filed on Apr. 10, 2015.

(51) Int. Cl.
*G09G 5/00* (2006.01)
*G09G 3/20* (2006.01)

(52) U.S. Cl.
CPC ..... *G09G 3/2096* (2013.01); *G09G 3/20* (2013.01); *G09G 2310/0267* (2013.01);
(Continued)

(58) Field of Classification Search
CPC ... G09G 2310/0267; G09G 2310/0286; G09G 2330/021
See application file for complete search history.

(56) References Cited

U.S. PATENT DOCUMENTS 5,084,839 A * 1/1992 Young ..... G11C 19/00 365/189.04
5,128,974 A * 7/1992 Maekawa ..... G11C 19/28 377/117

(Continued)

FOREIGN PATENT DOCUMENTS

KR 199409132 10/1994

OTHER PUBLICATIONS

"Latches, the D Flip-Flop & Counter Design", Feb. 6, 2012.*
Charles C. Lin, "What's a Tri-state Buffer?", 2003.*
"Latches, the D Flip-Flop & Design", Feb. 6, 2012.*

*Primary Examiner* — Benjamin C Lee
*Assistant Examiner* — Dong Hui Liang
(74) *Attorney, Agent, or Firm* — Treyz Law Group, P.C.; G. Victor Treyz; Jason Tsai

(57) ABSTRACT

A display may have an array of pixels controlled by display driver circuitry. Gate driver circuitry supplies gate line signals to rows of the pixels. The gate driver circuitry may include gate driver integrated circuits. Each gate driver integrated circuit may have a shift register that supplies the gate line signals to the rows of pixels. The display driver circuitry supplies a clock signal to the gate driver integrated circuits. Each gate driver integrated circuit may have one or more clock trees that are selectively enable and disabled. Each gate driver integrated circuit may have a controller and a buffer that is controlled by a control signal from the controller. The buffer may be adjusted to supply or to not supply the clock signal to an associated clock tree in that gate driver integrated circuit.

20 Claims, 6 Drawing Sheets

(52) U.S. Cl.
CPC ..... *G09G 2310/0286* (2013.01); *G09G 2310/0289* (2013.01); *G09G 2310/06* (2013.01); *G09G 2310/08* (2013.01); *G09G 2330/021* (2013.01)

(56) References Cited

U.S. PATENT DOCUMENTS

| | | | | |
|---|---|---|---|---|
| 5,990,857 | A * | 11/1999 | Kubota | G09G 3/3648 345/100 |
| 6,437,768 | B1 * | 8/2002 | Kubota | G09G 3/3688 345/100 |
| 6,809,711 | B2 | 10/2004 | Funston | |
| 7,557,623 | B2 | 7/2009 | Moehlmann et al. | |
| 7,920,210 | B2 | 4/2011 | Nagakura et al. | |
| 8,223,107 | B2 * | 7/2012 | Nakamura | G11C 19/00 345/100 |
| 8,487,655 | B1 | 7/2013 | Kutz et al. | |
| 2002/0190326 | A1 * | 12/2002 | Nagao | G09G 3/3648 257/359 |
| 2004/0044915 | A1 * | 3/2004 | Bose | G06F 1/04 713/320 |
| 2005/0179677 | A1 * | 8/2005 | Nojiri | G09G 3/3614 345/204 |
| 2007/0132673 | A1 * | 6/2007 | Jinno | G09G 3/006 345/76 |
| 2008/0297500 | A1 * | 12/2008 | Kato | G09G 3/3611 345/212 |

* cited by examiner

DISPLAY DRIVER CIRCUITRY WITH SELECTIVELY ENABLED CLOCK DISTRIBUTION

This application claims the benefit of provisional patent application No. 62/146,127 filed on Apr. 10, 2015, which is hereby incorporated by reference herein in its entirety.

BACKGROUND

This relates generally to electronic devices, and, more particularly, to electronic devices with displays.

Electronic devices such as cellular telephones, computers, and other electronic equipment often contain displays. A display includes an array of pixels for displaying images to a user. Display driver circuitry such as source line driver circuitry may supply data signals to the array of pixels. Gate line driver circuitry in the display driver circuitry can be used to assert a gate line signal on each row of pixels in the display in sequence to load data into the pixels.

Clock signals are distributed to registers in the gate line driver circuitry using clock signal distribution lines. Power is consumed when driving clock signals onto the clock signal distribution line. Excess power consumption can lead to undesired effects such as reduced battery life.

It would therefore be desirable to be able to reduce the amount of power consumed when distributing clock signals in the gate driver circuitry of a display.

SUMMARY

A display may have an array of pixels controlled by display driver circuitry. The display driver circuitry may supply data to columns of the pixels over data lines. The display driver circuitry may include gate driver circuitry that supplies gate line signals to rows of the pixels over gate lines.

The gate driver circuitry may include gate driver integrated circuits. Each gate driver integrated circuit may have a shift register that supplies the gate line signals to the rows of pixels. The display driver circuitry may supply a clock signal to the gate driver integrated circuits. Each gate driver integrated circuit may have one or more clock trees that distribute the clock signal to one or more respective shift registers.

The gate drive integrated circuits may contain control circuitry that controls the distribution of the clock signal to the clock trees. This allows the clock signal to be distributed to a subset of the clock trees to save power. Clock trees that are coupled to active shift register circuitry may receive the clock signal. Clock trees that are coupled to inactive shift register circuitry can be temporarily disabled.

Each gate driver integrated circuit may have a controller and a buffer that is controlled by a control signal from the controller. The buffer may be adjusted so as to supply or so as not to supply the clock signal to an associated clock tree in that gate driver integrated circuit.

DETAILED DESCRIPTION

Figure 1:
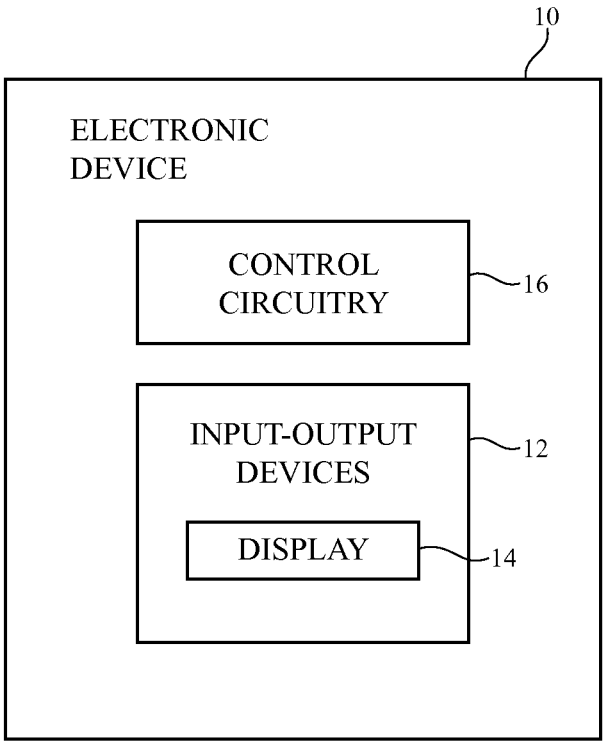
FIG. 1 is a schematic diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Device 10 may be a tablet computer, laptop computer, a desktop computer, a display, a cellular telephone, a media player, a wristwatch device or other wearable electronic equipment, or other suitable electronic device.

Display 14 may be an organic light-emitting diode display, a liquid crystal display, or a display based on other types of display technology. Configurations in which display 14 is a liquid crystal display may sometimes be described herein as an example.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
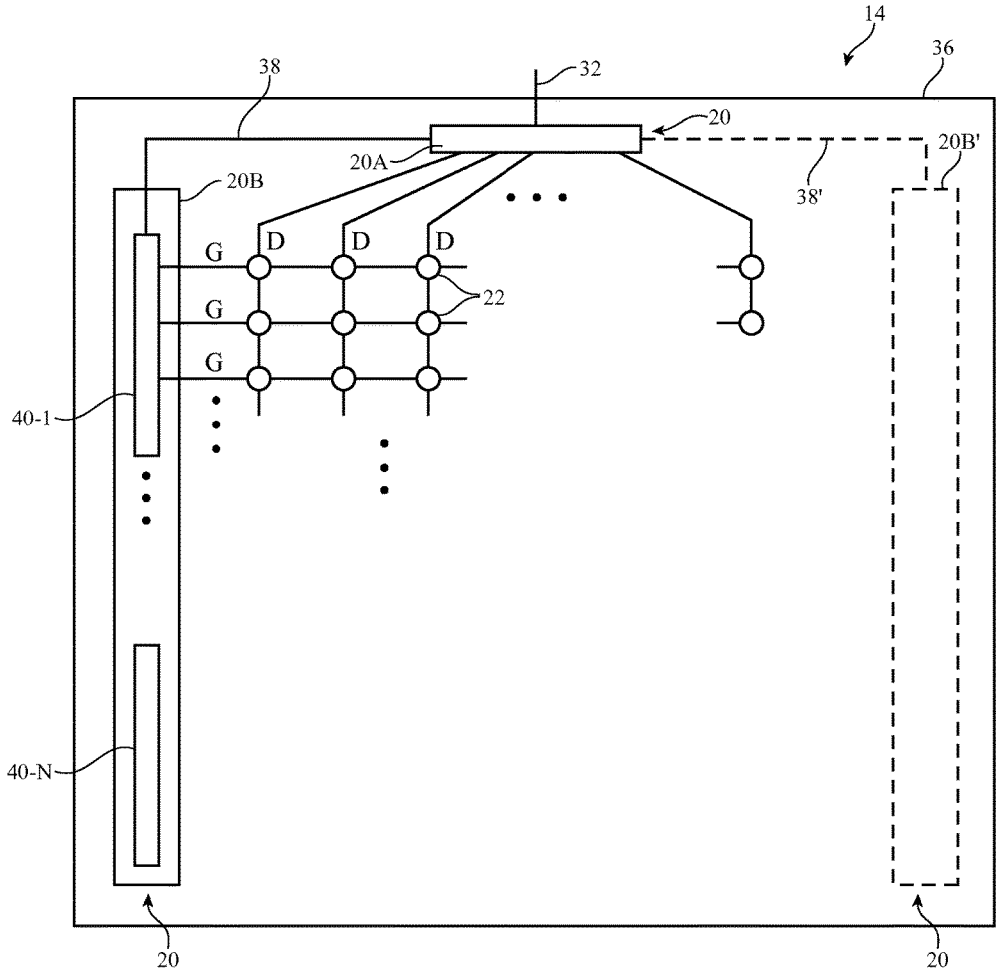
FIG. 2 is a top view of an illustrative display in an electronic device in accordance with an embodiment.

A top view of a portion of display 14 is shown in FIG. 2. As shown in FIG. 2, display 14 may have an array of pixels 22 formed from substrate structures such as substrate 36. Substrates such as substrate 36 may be formed from glass, metal, plastic, ceramic, or other substrate materials. Pixels 22 may receive data signals over signal paths such as data lines D and may receive one or more control signals over control signal paths such as horizontal control lines G (sometimes referred to as gate lines, scan lines, emission control lines, etc.). There may be any suitable number of rows and columns of pixels 22 in display 14 (e.g., tens or more, hundreds or more, or thousands or more). In organic light-emitting diode displays, pixels 22 contain respective light-emitting diodes and pixel circuits that control the application of current to the light-emitting diodes. In liquid crystal displays, pixels 22 contain pixel circuits that control the application of signals to pixel electrodes that are used for applying controlled amounts of electric field to pixel-sized portions of a liquid crystal layer. The pixel circuits in pixels 22 may contain transistors having gates that are controlled by gate line signals on gate lines G.

Display driver circuitry 20 may be used to control the operation of pixels 22. Display driver circuitry 20 may be formed from integrated circuits, thin-film transistor circuits, or other suitable circuitry. Thin-film transistor circuitry may be formed from polysilicon thin-film transistors, semiconducting-oxide thin-film transistors such as indium gallium zinc oxide transistors, or thin-film transistors formed from other semiconductors. Pixels 22 may have color filter elements of different colors (e.g., red, green, and blue) to provide display 14 with the ability to display color images.

Display driver circuitry 20 may include display driver circuits such as display driver circuit 20A and gate driver circuitry 20B. Display driver circuit 20A may be formed from one or more integrated circuits and/or thin-film transistor circuitry. Gate driver circuitry 20B may be formed from integrated circuits or may be thin-film "gate-on-array" circuitry. Display driver circuit 20A of FIG. 2 may contain communications circuitry for communicating with system control circuitry such as control circuitry 16 of FIG. 1 over path 32. Path 32 may be formed from traces on a flexible printed circuit or other conductive lines. During operation, the control circuitry (e.g., control circuitry 16 of FIG. 1) may supply circuit 20A with information on images to be displayed on display 14.

To display the images on display pixels 22, display driver circuitry 20A may supply image data to data lines D while issuing clock signals and other control signals such as a gate start pulse GSP and clock signal CLK to supporting display driver circuitry such as gate driver circuitry 20B over path 38. Circuitry 20A may supply clock signals and other control signals to gate driver circuitry 20B on one or both edges of display 14 (see, e.g., path 38' and gate driver circuitry 20B' on the right-hand side of display 14 in the example of FIG. 2).

Gate driver circuitry 20B (sometimes referred to as horizontal control line control circuitry) may control horizontal control lines (gate lines) G (e.g., G(1), G(2), G(3) . . . ). Gate lines G in display 14 may each carry a gate line signal for controlling the pixels 22 of a respective row (e.g., to turn on transistors in pixels 22 when loading data from the data lines into pixel storage capacitors in those pixels from data lines D). During operation, frames of image data may be displayed by asserting a gate signal on each gate line G in the display in sequence. Shift register circuitry (e.g., a chain of registers) in gate driver circuitry 20B may be used in controlling the gate line signals.

Multiple integrated circuits such as illustrative gate driver integrated circuits 40-1 . . . 40-N of FIG. 2 may be used in supplying gate signals G. The registers in each gate driver integrated circuit may be connected in a chain to form a shift register for that gate driver integrated circuit. The output of the last register in the shift register of each gate driver integrated circuit may be coupled to the input of the next gate driver integrated circuit in circuitry 20B to form a shift register that spans all of the gate lines in display 14. The registers may each receive a clock signal CLK from circuitry 20A. Clock trees may be used to distribute clock signal CLK within the gate driver integrated circuits. To conserve power, clock trees that are not being used may be disabled.

Figure 3:
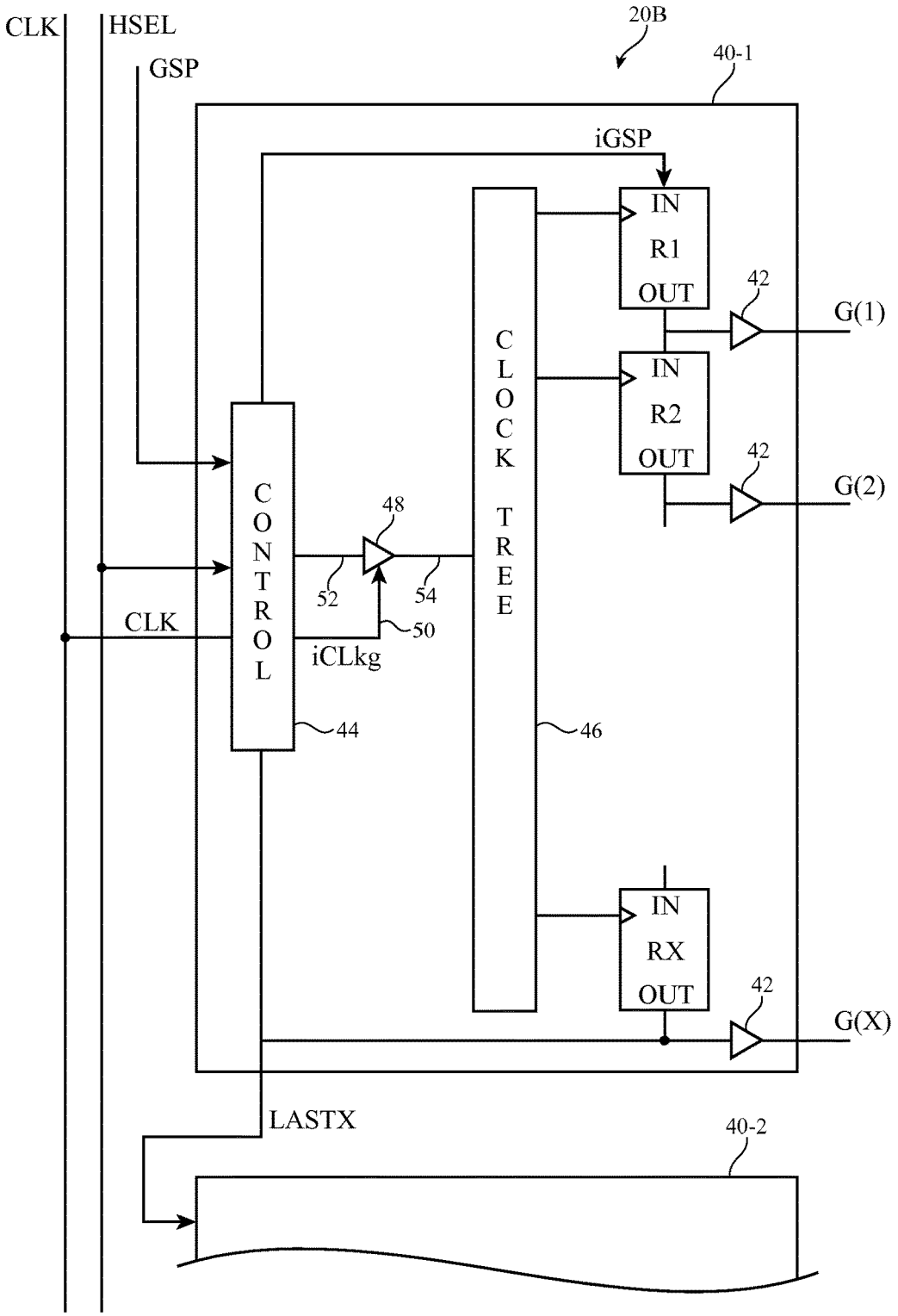
FIG. 3 is a circuit diagram of gate driver circuitry in a display in accordance with an embodiment.

A circuit diagram of illustrative gate driver circuitry 20B with clock tree control circuitry that allows inactive clock trees to be temporarily disabled is shown in FIG. 3. As shown in FIG. 3, gate driver circuitry 20B has multiple gate driver integrated circuits such as integrated circuits 40-1, 40-2, etc. Each gate driver integrated circuit has a chain of registers that form a shift register. For example, integrated circuit 40-1 has a shift register formed from registers R1, R2, . . . RX for asserting gate line signals G(1), G(2) . . . G(X) in sequence. The output OUT of each register is provided to the next register in the chain of registers to serve as a triggering input for that register.

The first register (R1) in circuit 40-1 is not coupled to the output of any preceding registers. Instead, circuit 20A generates a gate start pulse GSP to serve as the trigger signal for register R1. Gate start pulse GSP is distributed to register R1 by control logic 44 (sometimes referred to as internal clock gating logic, clock tree controller circuitry, or controller) as internal gate start pulse signal iGSP.

Gate driver integrated circuits 40-1, 40-2 . . . 40-N are coupled together by providing the output signal of the last register in each integrated circuit to the input IN of the first register in the next gate driver integrated circuit (see, e.g., output signal LASTX from last register RX of integrated circuit 40-1, which serves as the trigger input for the first register in integrated circuit 40-2).

Clock signal CLK is distributed to all gate driver integrated circuits in circuitry 20B. Within each gate driver integrated circuit, one or more clock trees such as clock tree 46 may be used to distribute clock signal CLK to the shift register circuitry of that gate driver integrated circuit. The clock signal distribution control circuitry of each gate driver integrated circuit includes controller 44 and buffer 48. Controller 44 receives signals such as gate start pulse signal GSP (the trigger signal for first register R1), signal HSEL (to select between operating modes such as a 1H mode, 2H mode, 3H mode, 4H mode, and, if desired additional operating modes such as an 8H mode, etc.), and clock signal CLK.

Clock distribution buffer 48 can be enabled and disabled by controller 44 using control signal iCLKg. Controller 44 supplies control signal iCLKg to buffer 48 using path 50. When signal iCLKg has one value (e.g., a low value), buffer 48 is enabled and clock signal CLK is passed from input 52 to output 54 so that clock tree 46 can distribute clock CLK to the shift register that is coupled to clock tree 46. When signal iCLKg has another value (e.g., a high value), buffer 48 is disabled. When buffer 52 is disabled, clock signal CLK is not driven into clock tree 46, which conserves power for gate driver circuitry 20B. At any given time during the operation of display 14, only about 1-8 registers are generally active and supplying gate line output signals. It is therefore not necessary for the registers of all gate lines G in display 14 (which may number in the hundreds or thousands) to be active at the same time. By disabling clock trees 46 that are not being actively used (e.g., by using controllers 44 in gate driver integrated circuits that are not actively producing gate line signals to disable the clock trees in those gate driver integrated circuits), unwanted power consumption that would otherwise arise from driving clock signals into these clock trees can be avoided.

Figure 4:
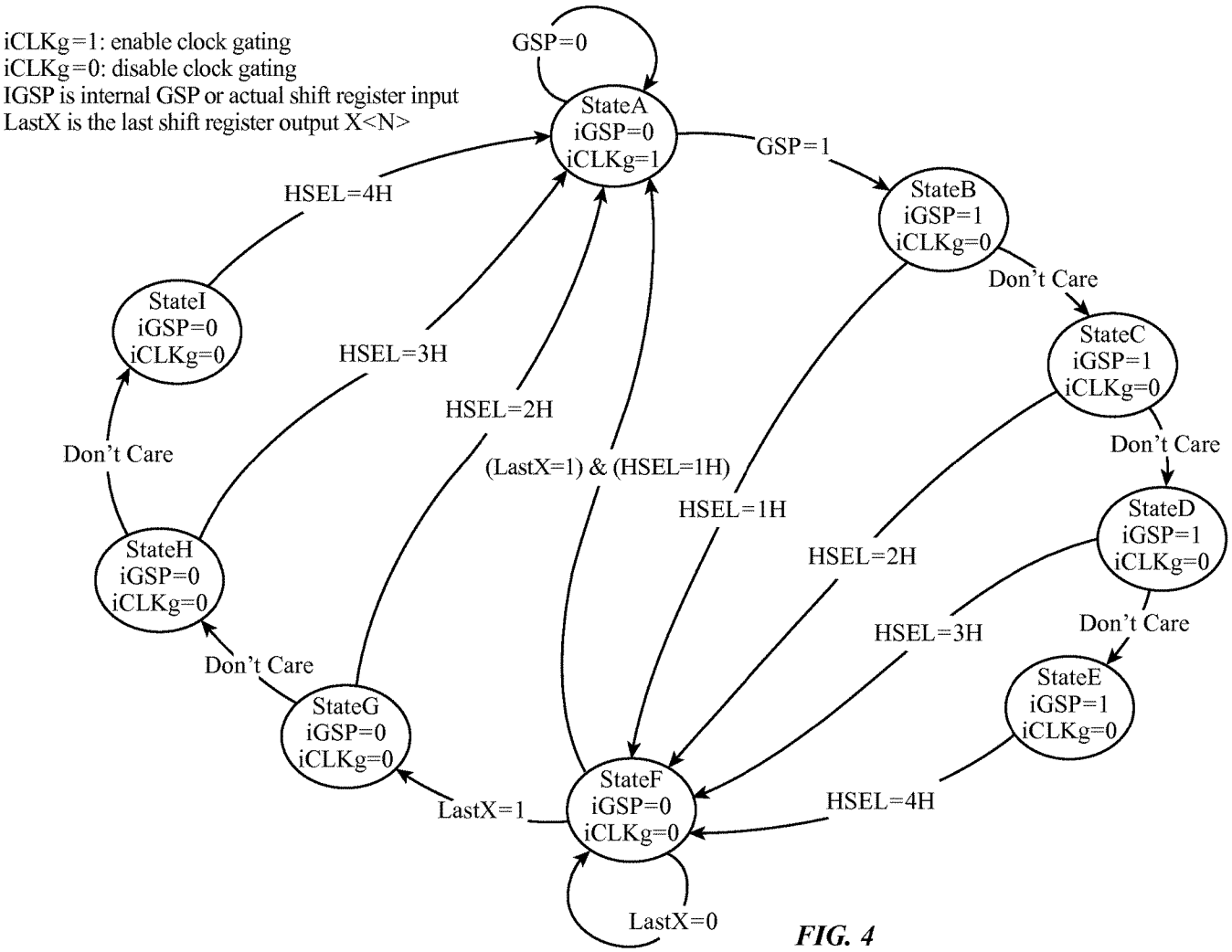
FIG. 4 is a state diagram showing the operation of internal clock gating logic in gate driver circuitry in accordance with an embodiment.

Each controller 44 can determine when to activate its corresponding clock tree 46 by operating in accordance with a state diagram of the type shown in FIG. 4. The illustrative state diagram of FIG. 4 supports 1H operation, 2H operation 3H operation, and 4H operation for its gate line signals (each having a different respective pulse duration ranging from one clock cycle for 1H to four clock cycles for 4H). Other modes of operation may be supported if desired. The example of FIG. 4 is merely illustrative.

In state A, controller 44 does not assert internal gate start pulse iGSP (i.e., iGSP is zero) and controller 44 holds clock distribution control signal iCLKg high to disable buffer 48 and thereby prevent clock signals from being driven into clock tree 46. While in state A, controller 44 awaits assertion of gate start pulse GSP by display driver circuitry 20A (or, for subsequent gate driver integrated circuits, controller 44 awaits assertion of the output LASTX from the last register in the shift register of the preceding gate driver integrated circuit, which serves as a trigger pulse).

When GSP is asserted (i.e., when controller 44 detects that GSP is high), controller 44 can conclude that the shift register circuitry of the gate driver integrated circuit containing controller 44 is being activated, so controller 44 may transition to state B. In state B, controller 44 takes signal iCLKg low to enable buffer 48 and thereby distribute clock signal CLK to clock tree 46 and the shift register circuitry. Because GSP is high, controller 44 takes internal gate start pulse iGSP high upon the first transition of clock signal CLK, thereby triggering operation of register R1 (and thereby starting the shift register of circuit 40-1).

Figure 5A:
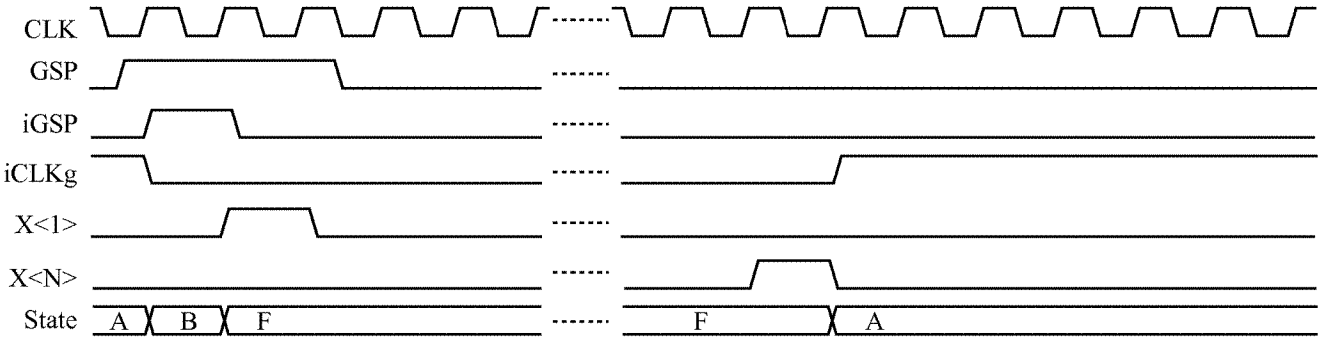
FIG. 5A is a timing diagram showing how the gate driver circuitry of FIG. 3 may operate in a 1H gate pulse scheme in accordance with an embodiment.

The length of time that signal iGSP is asserted (which controls the length of each gate line output pulse) depends on the mode of operation of display 14 (e.g., 1H, 2H, 3H, or 4H in the present example). If circuit 40-1 is being operated in 1H mode, signal HSEL will be equal to 1H and iGSP will be deasserted after one clock cycle (at which point controller 44 will transition to state F from state B), as shown in the illustrative 1H timing diagram of FIG. 5A. If circuit 40-1 is being operated in 2H mode, signal HSEL will be equal to 2H and iGSP will be deasserted after 2 clock cycles (i.e., operation of controller 44 will transition to state C for one clock cycle before transitioning to state EF). Operation in modes 3H and 4H is similar. If circuit 40-1 is being operated in 3H mode, signal HSEL will be equal to 3H and iGSP will be deasserted after 3 clock cycles (i.e., operation of controller 44 will transition from state C to state D for one additional clock cycle before transitioning to state F). If circuit 40-1 is being operated in 4H mode, signal HSEL will be equal to 4H and iGSP will be deasserted after 4 clock cycles (i.e., operation of controller 44 will transition from state D to state E for one additional clock cycle before transitioning to state F).

Figure 5B:
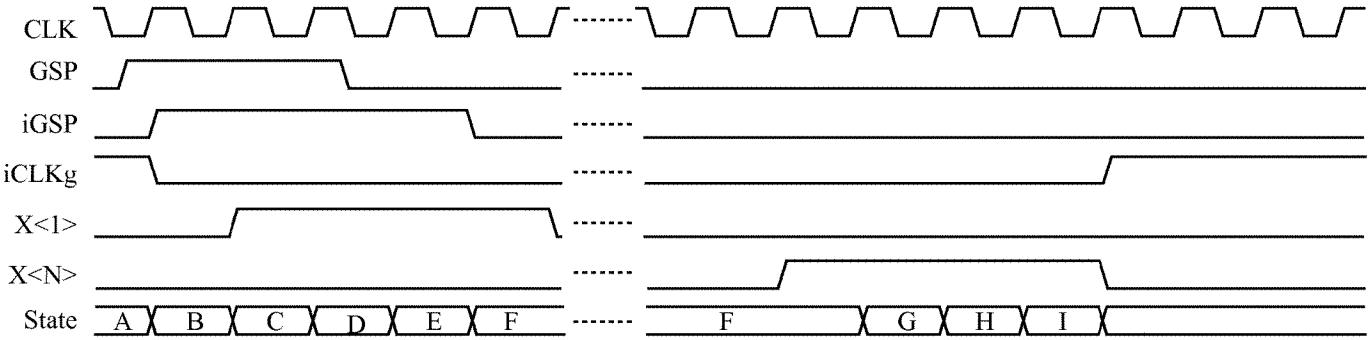
FIG. 5B is a timing diagram showing how the gate driver circuitry of FIG. 3 may operate in a 4H gate pulse scheme in accordance with an embodiment.

During state F, shift register operation continues (and gate lines G are asserted in succession) until the last gate line signal in the shift register is asserted (i.e., LASTX=1). When LASTX is asserted, controller 44 transitions to state A (i.e., clock tree 46 is disabled and controller 44 is idle and awaiting its next trigger pulse). As shown by states G, H, and I, 1, 2, or 3 additional clock cycles may be imposed before returning to state A from state F, depending on whether controller 44 is operating in 2H, 3H, or 4H mode. FIG. 5B is a timing diagram showing how the signals of FIG. 3 transition during 4H operation.

Figure 6:
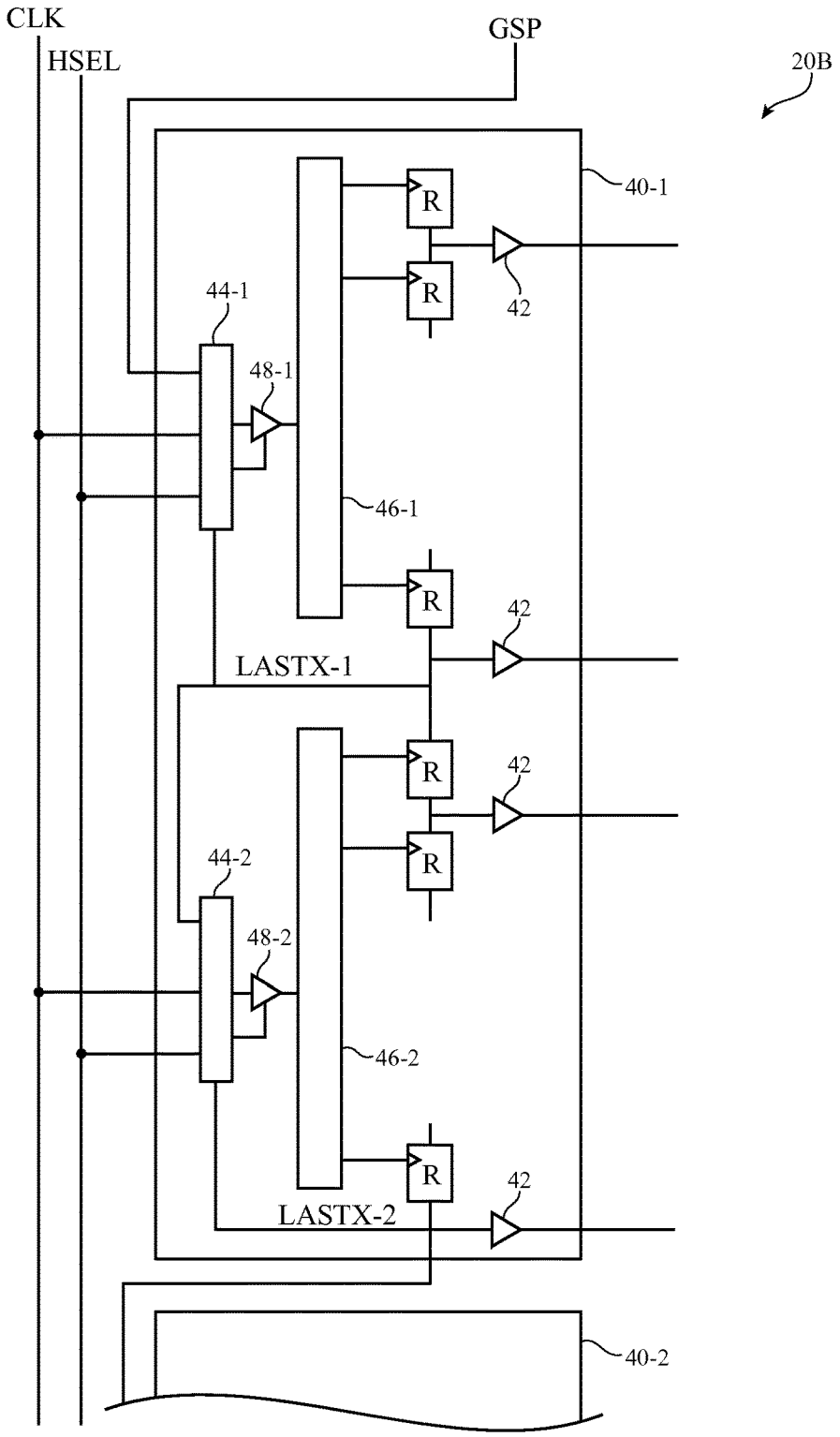
FIG. 6 is a circuit diagram showing how multiple clock trees can be selectively controlled within a gate driver integrated circuit that has been partitioned into sections each of which is clocked using a separate clock tree in accordance with an embodiment.

If desired, the gate driver circuits of circuitry 20B may be partitioned internally. This type of arrangement is shown in FIG. 6. In the example of FIG. 6, the shift register of circuit 40-1 has been partitioned into two parts—a first part that receives clock signals from clock tree 46-1 and a second part that is coupled in series with the first part and that receives clock signals from clock tree 46-2. Multiple controllers may be used to individually control each of the clock trees in circuit 40-1. For example, controller 44-1 may control buffer 48-1 to control when clock signal CLK is distributed to the first portion of the shift register using clock tree 46-1 and controller 44-2 may control buffer 48-2 to control when clock signal CLK is distributed to the second portion of the shift register using clock tree 46-2. In circuits with three or more clock trees, three (or more) respective controllers may be provided.

The use of multiple controllers within a single gate driver integrated circuit allows portions of the clock tree circuitry of the gate driver integrated circuit to be enabled when needed to produce gate line output signals while remaining portions of the clock tree circuitry of the same gate driver integrated circuit may be disabled to save power. The clock tree circuitry of other gate driver integrated circuits with inactive shift registers may be disabled using the controllers in those gate driver integrated circuits.

The foregoing is merely illustrative and various modifications can be made by those skilled in the art without departing from the scope and spirit of the described embodiments. The foregoing embodiments may be implemented individually or in any combination.

What is claimed is:

1. A display, comprising:

an array of pixels; and display driver circuitry that produces a clock signal, that provides data signals to columns of the pixels, and that has gate driver circuitry that provides gate line signals to rows of the pixels, wherein the gate driver circuitry includes:

shift registers that produce the gate line signals;

clock trees that distribute the clock signal to the shift registers; and control circuitry that selectively enables and disables the clock trees, wherein the control circuitry receives a gate start pulse signal and generates a corresponding internal gate start pulse signal that has a different pulse width than the received gate start pulse signal and that is fed to at least one of the shift registers, and wherein the internal gate start pulse signal controls the pulse width of the gate line signals.

2. The display defined in claim 1 wherein the gate driver circuitry comprises a plurality of gate driver integrated circuits.

3. The display defined in claim 2 wherein each gate driver integrated circuit includes one of the clock trees and one of the shift registers and wherein the shift register in that gate driver integrated circuit receives the clock signal from the clock tree in that gate driver integrated circuit.

4. The display defined in claim 3 wherein the control circuitry includes controllers and buffers and wherein each of the gate driver integrated circuits includes a respective one of the controllers and a respective one of the buffers.

5. The display defined in claim 4 wherein the controller in each gate driver integrated circuit produces a control signal that is applied to the buffer in that integrated circuit.

6. The display defined in claim 5 wherein the controller in each gate driver integrated circuit places the control signal in a first state to enable the buffer in that gate driver integrated circuit and places the control signal in a second state to disable the buffer in that gate driver integrated circuit.

7. The display defined in claim 6 wherein the buffer in each gate driver integrated circuit receives the clock signal and has an output coupled to the clock tree in that gate driver integrated circuit.

8. The display defined in claim 7 wherein the buffer in each gate driver integrated circuit distributes the clock signal to the clock tree in that gate driver integrated circuit when that buffer is enabled and does not distribute the clock signal to the clock tree when that buffer is disabled.

9. The display defined in claim 8 wherein the shift register in each gate driver integrated circuit has at least a first register and a last register.

10. The display defined in claim 9 wherein the first register in each gate driver integrated circuit receives the internal gate start pulse signal from the controller in that gate driver integrated circuit.

11. The display defined in claim 10 wherein the last register in each gate driver integrated circuit supplies an output signal to the controller in that gate driver integrated circuit.

12. The display defined in claim 11 wherein the controller in each gate driver integrated circuit adjusts the control signal based at least partly on the output signal from the last register.

13. The display defined in claim 1 wherein the gate driver circuitry comprises a plurality of gate driver integrated circuits and each gate driver integrated circuit includes a plurality of the clock trees and a plurality of the shift registers, and wherein each shift register in that gate driver integrated circuit receives the clock signal from a respective one of the clock trees in that gate driver integrated circuit.

14. The display defined in claim 13 wherein the plurality of clock trees in each gate driver integrated circuit include at least first and second clock trees, wherein the control circuitry includes at least first and second controllers and first and second buffers in each gate driver integrated circuit, wherein the first and second controllers in each gate driver integrated circuit produce first and second respective control signals that are applied respectively to the first and second buffers in that gate driver integrated circuit, and wherein the first and second control signals selectively enable and disable the first and second buffers to control distribution of the clock signal to the first and second clock trees in that gate driver integrated circuit.

15. A display, comprising:

an array of pixels; and display driver circuitry that produces a clock signal, that provides data signals to columns of the pixels, and that has gate driver circuitry that provides gate line signals to rows of the pixels, wherein the gate driver circuitry includes:

a plurality of gate driver integrated circuits, each gate driver integrated circuit having a shift register that produces a respective plurality of the gate line signals;

a clock tree that distributes the clock signal to the shift register; and control circuitry that selectively enables and disables the clock tree, wherein the control circuitry receives an adjustable mode control signal that determines how long the clock tree is enabled, wherein the length of the shift register and the frequency of the clock signal remain constant when the adjustable mode control signal is adjusted, and wherein the adjustable mode control signal controls the pulse width the gate line signals.

16. The display defined in claim 15 wherein the control circuitry of each gate driver integrated circuit comprises a buffer that is controlled by a control signal and a controller that receives the clock signal and that provides the clock signal and the control signal to the buffer and wherein the buffer has an output that is coupled to the clock tree of that gate driver integrated circuit.

17. The display defined in claim 16 wherein the controller in each gate driver integrated circuit adjusts the control signal to control whether the buffer passes or does not pass the clock signal to the clock tree in that gate driver integrated circuit.

18. A display, comprising:

an array of pixels; and display driver circuitry that produces a clock signal, that provides data signals to columns of the pixels, and that has gate driver circuitry that provides gate line signals to rows of the pixels, wherein the gate driver circuitry includes a plurality of gate driver integrated circuits, each gate driver integrated circuit having:

a shift register that produces a respective plurality of the gate line signals;

a clock tree that distributes the clock signal to the shift register;

a buffer having an output coupled to the clock tree; and a controller that receives a gate start pulse and an adjustable mode control signal, that supplies a control signal to the buffer to control whether the buffer supplies the clock signal to the clock tree in that gate driver integrated circuit, and that supplies a corresponding internal gate start pulse with an adjustable pulse width to the shift register, wherein the adjustable mode control signal adjusts the pulse width of the internal gate start pulse, and wherein the internal gate start pulse signal controls the pulse width of the gate line signals.

19. The display defined in claim 18 wherein the shift register in each gate driver integrated circuit supplies an output signal to the controller in that integrated circuit.

20. The display defined in claim 19 wherein the shift register in each gate driver integrated circuit includes a first register and a last register, wherein the last register supplies the output signal to the controller, and wherein the first register receives the internal gate start pulse from the controller.

* * * * *